United States Patent [19]

Eckstein et al.

[11] 4,366,770

[45] Jan. 4, 1983

[54] APPARATUS FOR APPLYING A WATER REPELLENT SUBSTANCE INTO A CABLE CORE

[75] Inventors: Horst Eckstein, Rödental; Willi Seyfart, Haarbrücken; Norbert Sutor, Neustadt, all of Fed. Rep. of Germany

[73] Assignee: Siemens Aktiengesellschaft, Munich, Fed. Rep. of Germany

[21] Appl. No.: 901,484

[22] Filed: May 1, 1978

[30] Foreign Application Priority Data

Jun. 9, 1977 [DE] Fed. Rep. of Germany ..... 2726404

[51] Int. Cl.[3] ..... B05C 3/12; H01B 13/16

[52] U.S. Cl. ..... 118/405; 156/48; 156/381; 174/25 R; 174/25 P; 174/26 R; 174/116; 427/117; 427/434.2; 427/434.5; 428/396; 427/434.7

[58] Field of Search ..... 118/404, 405; 156/48, 156/145, 381; 174/25 R, 25 P, 26 R, 113 R, 113 C, 116; 427/117, 434.2, 434.5, 434.7; 428/396

[56] References Cited

U.S. PATENT DOCUMENTS

| | | | |
|---|---|---|---|
| 1,163,342 | 12/1915 | Hurley et al. | 174/25 P |
| 1,835,922 | 12/1931 | Zeiss et al. | 174/25 P |
| 3,733,216 | 5/1973 | Goldman et al. | 118/405 X |
| 3,996,081 | 12/1976 | Nakata | 156/48 |
| 4,009,296 | 2/1977 | Löb et al. | 156/48 X |
| 4,123,304 | 10/1978 | Gaudette | 156/48 |

*Primary Examiner*—Caleb Weston
*Assistant Examiner*—Robert A. Dawson
*Attorney, Agent, or Firm*—Kenyon & Kenyon

[57] ABSTRACT

In order to reach every void between the individual cable conductors, particularly when filling a multi-pair communication cable, the water repellent substance is supplied to the cable core in great excess; a filling basin surrounding the filling station proper collects the re-emerging excess substance.

5 Claims, 1 Drawing Figure

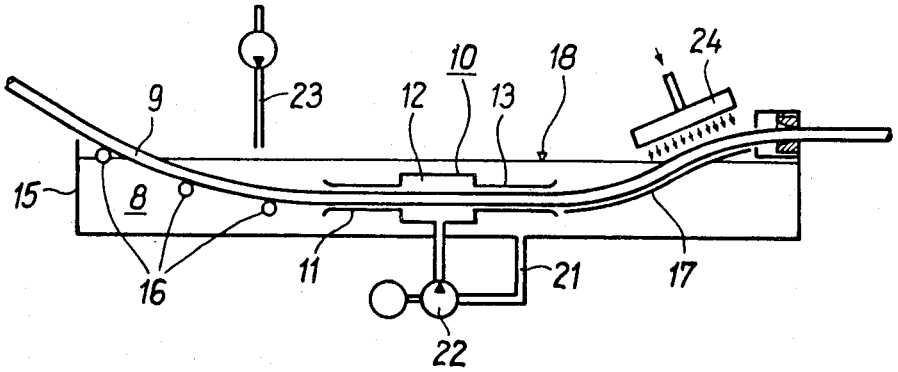
10
18
24
9
23
12
13
15
8
16
11
21
17
22

APPARATUS FOR APPLYING A WATER REPELLENT SUBSTANCE INTO A CABLE CORE

BACKGROUND OF THE INVENTION

This invention relates to cables in general and more particularly to a method and apparatus for applying a water repellent substance into the cable core of a multi-pair cable, especially a communication cable.

Methods are known for applying a water repellent substance into the cable core of a multi-pair cable where the cable core is led through a filling vessel consisting of an inlet stub, a filling head and an outlet stub, and in which the water repellent substance to be applied into the cable core is contained at elevated temperature and relatively high pressure.

With the transition from paper-insulated to plastic-insulated cable conductors, especially in multi-pair communication cables, the problem of leakage water spreading over large sections of the cable has arisen. Such leakage can destroy the cable to a large extent or make it inoperative. While the formerly used paper insulation formed a natural obstacle to the spreading of the leakage water by swelling when water is present, this obstacle no longer exists when plastic insulation is used. Ever since plastic-insulated cable conductors have been adopted, therefore, there have been attempts to build up special batteries for leakage water that may get in.

In the meantime, the literature related to this problem has become very extensive. The remedy best suited for this problem has been found to be filling the voids between the cable conductors with a water repellent substance of high viscosity. Accordingly, a large number of proposals exist as to the form in which such substances can be applied to a cable. The question as to in what way it can be ensured that all voids are filled with this substance is particularly discussed. If only a single void extending over greath lengths is not filled, the danger of leakage water spreading along the cable remains.

In the majority of the known proposals, the procedure is to bring the water repellent substance into the core before the sheath is applied. Then, the substance is usually heated above the ambient temperature in order to reduce the viscosity substantially. Also, in order to fill all voids between the cable conductors, one works, almost without exception, with a pressure difference. In a number of cases, the cable core and the filling station are evacuated first; in many cases one works with overpressure which is to press the water repellent substance into the voids between the individual cable conductors.

In the known embodiments, that is, where overpressure as well as underpressure is used, sealing problems must be overcome. If tight seals are used in the vicinity of the entry and exit points of the cable core into or out of the filling station, there is danger that the cable core might be damaged by excessive mechanical stress. If, on the other hand, the seal is not sufficient, adequate vacuum cannot be maintained in the filling station or, in the case of overpressure, the necessary pressure of the water repellent cannot be obtained.

SUMMARY OF THE INVENTION

It is therefore an object of the present invention to develop the method and the apparatus of the type mentioned at the outset so that the above-mentioned disadvantages are largely avoided. According to the present invention, for solving this problem, the method mentioned above is performed in such a manner that the amount of water repellent substance fed to the filling head is about 20 to 50 times the amount absorbed by the cable core.

The high mass excess ensures that, in the vicinity of the filling head, as well as in the vicinity of the inlet and outlet stubs (filling tubes), a pressure sufficient for the method is obtained without the need for seals placed over the cable core, and the cable core is reliably filled completely with the water repellent substance. The large mass excess and thereby, the relatively high flow velocity can be achieved without difficulty by a pump of appropriately high power.

The apparatus according to the present invention for carrying out the method according to the present invention is designed so that the filling head which brings the water repelling substance into the cable core is made pressure proof and is surrounded, including its inlet and outlet stubs, by a filling basin; the filling basin and the filling head are connected via a circulation line with an interposed pump.

By using a filling basin which completely surrounds the filling unit proper, in conjunction with the circulation line and the interposed pump, care is automatically taken that no water repellent substance can get outside the device. In this device, which can be considered as a double tank, provision need only be made that the substance which is depleted by the filling process proper, is replenished to the required extent.

If the apparatus according the present invention is further made so that the filling unit is arranged in the filling basin in such a manner that the filling vessel is completely enclosed by the water repellent substance, a further important advantage is obtained because the filling unit need not be equipped with heating devices of its own, since the large heat content of the water repellent substance surrounding the parts of the filling unit makes this unnecessary. As a result, the filling head as well as the entry and exist stubs (filling tubes) can be rather simple as compared to similar known devices.

To make it possible to immerse the filling unit fully into the water repellent substance in the filling basin for each cable core, spatially adjustable deflection devices which may consist, for instance, of rolls are arranged ahead of the entry stub and behind the exist stub. It is of particular advantage to make the deflection device for the already filled cable core behind the exit stub in the form of a slide channel, as in that case a possible escape of the filling substance due to a squeezing action of the rolls is avoided.

The method according to the present invention is especially effective if, particularly in communication cables with many pairs, the cable core is enclosed, before the sheath is applied, by a woven tape which is applied on the cable core with a bias during the twisting process or immediately thereafter in such a manner that the woven tape has the same length of lay as the pitch of the twist of the core.

This woven tape has the advantage that it prevents the water repellent substance, once it is filled in, from leaving the cable core again, and it provides, in addition, supplemental mechanical protection of the cable core during the filling process, particularly in the case of sensitive cores such as those where the conductor insulation consists of cellular polethylene. The use of the woven tape becomes possible only in the method according to the present invention, because, due to the large mass excess in the filling head, a sufficiently high pressure is also obtained which brings about sufficient penetration velocity of the water repellent substance to be filled in through the woven tape.

BRIEF DESCRIPTION OF THE DRAWING

The single FIGURE is a diagrammatical longitudinal section through apparatus for applying a water repellent substance into a cable core.

DETAILED DESCRIPTION OF THE INVENTION

The filling unit 10 proper consists of an entry stub 11, a filling head 12 and an exit stub 13. This unit is arranged in a box shaped filling basin 15 in such a manner that it is completely enclosed by a water repellent substance 8 which is to be applied into the cable core 9. The bottom of the filling basin is connected via a circulation line 21 and an interposed, high-power pump 22, to the filling head 12. Ahead of the entry stub 11, a deflecting device in the form of rolls 16 is provided, the height of which can be adjusted for adapting to the diameter of the cable core to be filled. A corresponding deflection device 17 behind the exit stub 13 is designed in the form of a slide channel, to largely prevent premature escape of the filling substance by squeezing action of guide rolls. The filling basin 15 is made heatable and is filled with the water repellent substance 8 up to the level 18. A replenishing line 23 is used to replace the amount of substance absorbed by the cable core. The ratio of the amount of substance $m_1$ conducted through the line 23 to the amount of substance $m_2$ going through the circulation line 21 is about 1:40. Before the cable core leaves the filling basin, a cooling device 24 is provided, by means of which cold air is blown against the cable core in order to largely prevent the water repellent substance which has been filled in from dripping off.

What is claimed is:

1. In apparatus for applying a water repellent substance into the cable core of a multi-pair communication cable, where the cable core is led through a filling unit consisting of an entry stub, a filling head and an exit stub and in which the water repellent substance to be inserted into the cable core is contained at elevated temperature and relatively high pressure, the improvement comprising:

(a) a filling unit for the insertion of the water repellent substance into the cable core which is pressure proof, (b) a filling basin surrounding the filling unit including its entry and exit stub, and (c) a circulation line with a pump interposed connecting the filling basin and the filling unit.

2. The improvement according to claim 1, wherein said filling unit including the entry stub, the filling head and the exit stub is arranged in the filling basin in such a manner that the filling unit is completely enclosed by the water repellent substance.

3. The improvement according to claim 2, and further including spatially adjustable deflecting devices arranged in the filling basin ahead of the entry stub and behind the exit stub.

4. The improvement according to claim 3, wherein deflecting device ahead of the entry stub comprises several rolls.

5. The improvement according to claim 3, wherein deflecting device behind the exit stub comprises a slide channel.

* * * * *